US007584821B2

(12) United States Patent
Prior et al.

(10) Patent No.: US 7,584,821 B2
(45) Date of Patent: Sep. 8, 2009

(54) ADJUSTABLE HELMHOLTZ RESONATOR

(75) Inventors: Gregory P. Prior, Birmingham, MI (US); Roxanne M. Bittner, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 106 days.

(21) Appl. No.: 11/625,902

(22) Filed: Jan. 23, 2007

(65) Prior Publication Data

US 2008/0173271 A1 Jul. 24, 2008

(51) Int. Cl.
*F01N 1/18* (2006.01)

(52) U.S. Cl. ..... 181/241; 181/249; 181/250; 181/255; 181/266; 181/272; 181/273; 181/276; 181/277

(58) Field of Classification Search ..... 181/241, 181/249, 250, 251, 255, 264, 266, 269, 271, 181/272, 273, 275, 276, 277
See application file for complete search history.

(56) References Cited

U.S. PATENT DOCUMENTS

| | | | | |
|---|---|---|---|---|
| 3,141,519 | A * | 7/1964 | Bottum | 181/241 |
| 3,253,676 | A * | 5/1966 | Bottum | 181/241 |
| 5,468,923 | A * | 11/1995 | Kleyn | 181/282 |
| 5,892,186 | A * | 4/1999 | Flugger | 181/252 |
| 5,979,598 | A * | 11/1999 | Wolf et al. | 181/272 |
| 6,752,240 | B1 * | 6/2004 | Schlagenhaft | 181/249 |
| 2003/0085071 | A1 * | 5/2003 | Boast et al. | 181/249 |
| 2005/0150718 | A1 * | 7/2005 | Knight et al. | 181/250 |
| 2005/0252716 | A1 * | 11/2005 | Moenssen et al. | 181/277 |

* cited by examiner

*Primary Examiner*—Jeffrey Donels
*Assistant Examiner*—Jeremy Luks

(57) ABSTRACT

An adjustable Helmholtz resonator assembly is provided having an active state and an inactive state. In the active state the Helmholtz resonator assembly is operable to attenuate pressure pulsations within air passing therethrough. In the inactive state the Helmholtz resonator assembly does not attenuate pressure pulsations within air passing therethrough. The Helmholtz resonator assembly is preferably configured to be mounted within an intake system of an internal combustion engine.

14 Claims, 3 Drawing Sheets

ADJUSTABLE HELMHOLTZ RESONATOR

TECHNICAL FIELD

The present invention relates to an adjustable Helmholtz resonator configured for use with an internal combustion engine.

BACKGROUND OF THE INVENTION

Various methods may be employed to reduce the intake noise of an internal combustion engine. One method is to use a Helmholtz resonator on an intake air pipe configured to communicate intake air to the internal combustion engine. The intake air pipe is typically disposed upstream from an intake manifold and is configured to communicate intake air to the intake manifold of the internal combustion engine. A Helmholtz resonator includes a resonance volume or chamber having a small opening, typically referred to as a neck. The neck is operable to enable communication between the resonance chamber and the intake air pipe. Sound waves generated by components within the internal combustion engine travel along the intake air pipe where their acoustic pressure impinges on the neck and excites a mass of air within the neck. The acoustic pressure within the resonance chamber reacts against the air mass within the neck and produces an out-of-phase acoustic pressure at the intake air pipe to cause cancellation of intake noise at the resonant frequency. In this way, some of the engine noise is eliminated as the out-of-phase acoustic pressures in the intake air pipe cancel each other.

SUMMARY OF THE INVENTION

A Helmholtz resonator assembly is provided having a housing partially defining at least one volume and a first generally cylindrical sleeve member disposed within the housing and further defining the at least one volume. A second generally cylindrical sleeve member is generally coaxially disposed within the generally cylindrical first sleeve member and defines a passage through which a gas may pass. The second generally cylindrical sleeve member is selectively and variably movable between a first position and a second position with respect to the first generally cylindrical sleeve member. At least one orifice is defined by the first generally cylindrical sleeve member and at least one other orifice is defined by the second generally cylindrical sleeve member. The second generally cylindrical sleeve member is operable to substantially block the at least one orifice to prevent communication between the at least one volume and the passage when the second generally cylindrical sleeve member is in the first position. The at least one other orifice of the second generally cylindrical sleeve member is operable to unblock the at least one orifice to allow communication between the at least one volume and the passage when the second generally cylindrical sleeve member is in the second position. The at least one orifice, the at least one other orifice, and the at least one volume cooperate to form at least one Helmholtz resonator when the at least one orifice is unblocked by the second generally cylindrical sleeve member. An actuator responsive to signals from a controller may be provided. The actuator is preferably configured to selectively and variably move the second sleeve member between the first position and the second position.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
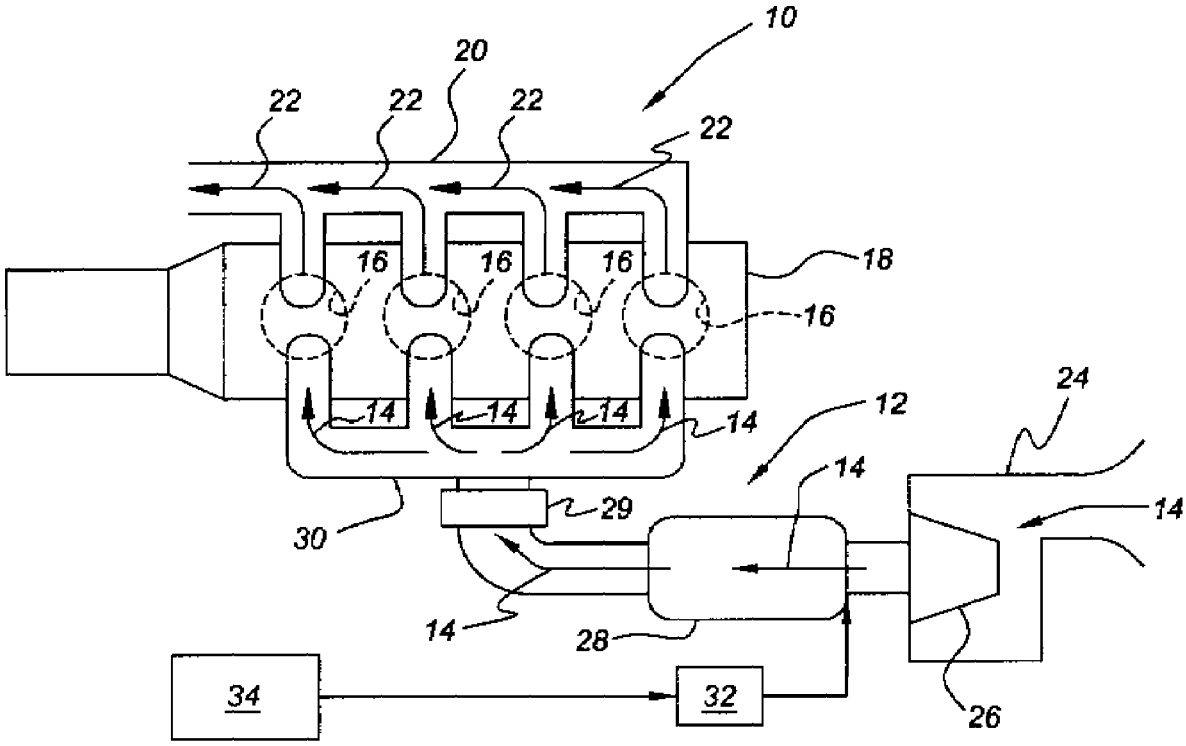
FIG. 1 is a schematic diagrammatic illustration of an internal combustion engine having an intake system with an adjustable Helmholtz resonator assembly disposed therein.

Referring to the drawings wherein like reference numbers correspond to like or similar components throughout the several figures there is schematically depicted in FIG. 1 an internal combustion engine 10. The internal combustion engine 10 may be configured to operate in one of a spark-ignited or compression-ignited mode of operation. The internal combustion engine 10 includes an intake system 12 operable to communicate a gas, such as intake air 14 to a plurality of cylinders 16 defined by an engine block 18 of the internal combustion engine 10. The internal combustion engine 10 further includes an exhaust system 20 operable to exhaust or extract products of combustion 22 from the cylinders 16.

The intake system 12 includes an air box 24 configured to hold a filter element 26 operable to filter or remove particulate matter from the intake air 14 prior to introduction to a Helmholtz resonator assembly 28. The Helmholtz resonator assembly 28 is configured to mount to a supercharger assembly 29. The supercharger assembly 29 operates to increase the volume of intake air 14 communicated to an intake manifold 30 thereby increasing the volumetric efficiency of the internal combustion engine 10. The intake manifold 30 is operable to distribute or communicate intake air 14 to the cylinders 16.

The Helmholtz resonator assembly 28 is adjustable, that is, can be switched from an active state, wherein noise producing pressure pulsations within the intake air 14 are substantially attenuated, to an inactive state, wherein the noise producing pressure pulsations within the intake air 14 are not attenuated. This is especially beneficial in instances where the internal combustion engine 10 is supercharged. The supercharger 29 may produce a high pitched "whine" which may be objectionable to some individuals, but not others. The Helmholtz resonator assembly 28 allows the flexibility to selectively attenuate this whine should the vehicle operator find it objectionable. An actuator 32 is configured to adjust the Helmholtz resonator assembly 28 in response to signals received from a controller 34. The construction and operation of the Helmholtz resonator 28 will be described in greater detail hereinbelow with reference to FIGS. 2 through 3.

Figure 2:
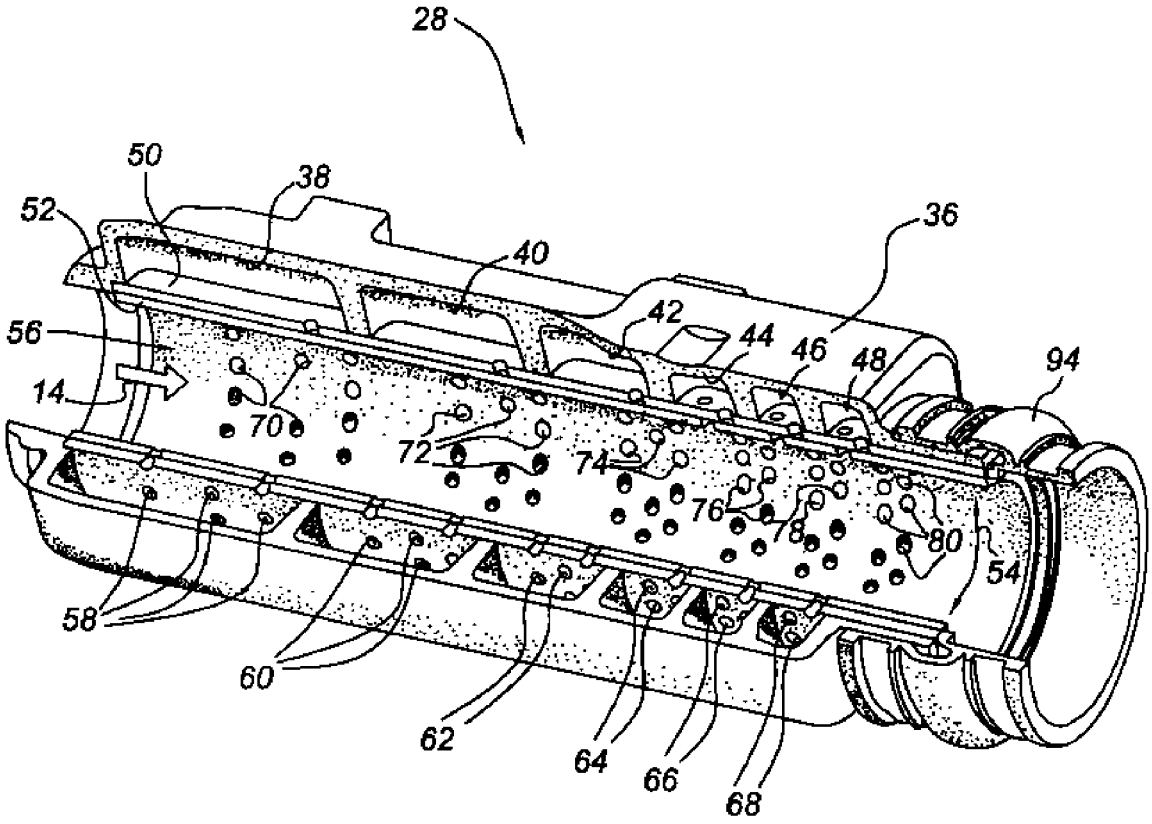
FIG. 2 is a perspective three quarter sectional view of the adjustable Helmholtz resonator assembly, schematically depicted in FIG. 1, illustrating the Helmholtz resonator assembly in an inactive state.
Figure 3:
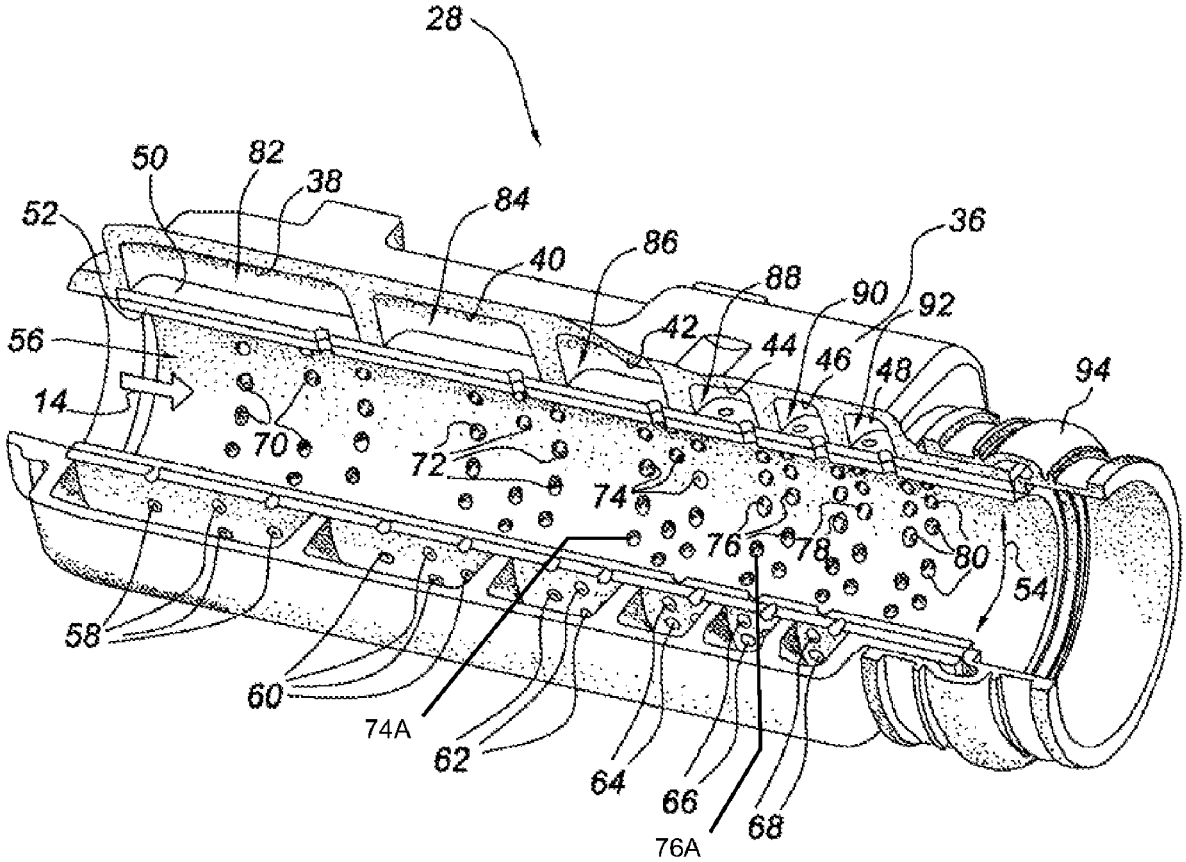
FIG. 3 is a perspective three quarter sectional view of the adjustable Helmholtz resonator assembly of FIG. 2 illustrating the Helmholtz resonator assembly in an active state.

Referring now to FIGS. 2 and 3, there is shown a three quarter sectional view of the Helmholtz resonator assembly 28. The Helmholtz resonator assembly 28 includes a housing 36 partially defining a first, second, third, fourth, fifth, and sixth chamber or volume 38, 40, 42, 44, 46, and 48, respectively. A first generally cylindrical sleeve member 50 is disposed within the housing 36 and further defines each of the first, second, third, fourth, fifth, and sixth volumes 38, 40, 42, 44, 46, and 48. A second generally cylindrical sleeve member 52 is coaxially disposed within the first sleeve member 50. The second sleeve member 52 is rotatably movable within the first sleeve member 50, as indicated by arrows 54. The second sleeve member 52 defines a passage 56 through which the intake air 14 passes.

The first sleeve member 50 defines a first, second, third, fourth, fifth, and sixth plurality of orifices 58, 60, 62, 64, 66, and 68, respectively, while the second sleeve member 52 defines a first, second, third, fourth, fifth, and sixth plurality of orifices 70, 72, 74, 76, 78, and 80, respectively. The second sleeve member 52 is movable between a first position, as shown in FIG. 2, and a second position, as shown in FIG. 3. With the second sleeve member 52 in the first position, the second sleeve member substantially blocks the first, second, third, fourth, fifth, and sixth volumes 38, 40, 42, 44, 46, and 48 from communicating with the passage 56 through the first, second, third, fourth, fifth, and sixth plurality of orifices 58, 60, 62, 64, 66, and 68. Therefore, with the second sleeve member 52 in the first position the Helmholtz resonator assembly 28 is in an inactive state and no attenuation of noise producing pressure pulsations within the intake air 14 occurs.

With the second sleeve member 52 in the second position the first, second, third, fourth, fifth, and sixth plurality of orifices 58, 60, 62, 64, 66, and 68 of the first sleeve member 50 are aligned with the first, second, third, fourth, fifth, and sixth plurality of orifices 70, 72, 74, 76, 78, and 80 of the second sleeve member 52. Therefore, the second sleeve member 52 allows the communication between the first, second, third, fourth, fifth, and sixth volumes 38, 40, 42, 44, 46, and 48 and the passage 56. As such, respective first, second, third, fourth, fifth, and sixth plurality of orifices 58, 60, 62, 64, 66, and 68; first, second, third, fourth, fifth, and sixth plurality of orifices 70, 72, 74, 76, 78, and 80; and first, second, third, fourth, fifth, and sixth volumes 38, 40, 42, 44, 46, and 48 cooperate to form first, second, third, fourth, fifth, and sixth Helmholtz resonators 82, 84, 86, 88, 90, and 92, respectively, as shown in FIG. 3. Therefore, with the second sleeve member 52 in the second position the Helmholtz resonator assembly 28 is in an active state to allow the attenuation of noise producing pressure pulsations within the intake air 14 to occur.

The first, second, third, fourth, fifth, and sixth plurality of orifices 70, 72, 74, 76, 78, and 80, defined by the second sleeve member 52, may include slot-like orifices to permit the second sleeve member 52 to unblock the first, second, third, fourth, fifth, and sixth plurality of orifices 58, 60, 62, 64, 66, and 68 in a staggered or step-like fashion as the second sleeve moves from the first position to the second position thereby enabling variable tuning of the Helmholtz resonator assembly 28. This is illustrated in FIG. 3 by orifices 74A and 76A which are not in rotational alignment with one another. Therefore, as the second sleeve member 52 is rotated orifice 74A will align with orifice 64 prior to orifice 76A aligning with orifice 66. As illustrated in FIGS. 2 and 3, the first, second, third, fourth, fifth, and sixth volumes 38, 40, 42, 44, 46, and 48 are of different sizes; therefore, a plurality of frequencies may be attenuated by the Helmholtz resonator assembly 28 when in the active state. The housing 36 and the first and second sleeve members 50 and 52 are preferably formed from plastic. The housing is configured to be mounted within the intake system 12 of the internal combustion engine 10, shown schematically in FIG. 1, by a coupling member 94. The coupling member 94 is preferably formed from an elastomeric material such as rubber. Preferably, the actuator 32, shown in FIG. 1, would effect movement of the second sleeve member 52, through the coupling member 94. In this way, a seal is maintained within the intake system 12 to prevent the leakage of ambient air into the intake air 14. Actuation may be effected by pressing a lever, not shown, attached to the second sleeve member 52 through the coupling member 94. Additionally, actuation may be effected via a solenoid, not shown, acting on the second sleeve member 52 via a ferrous plunger, not shown, or lever, not shown. Although the second sleeve member 52 is shown in FIGS. 2 and 3 to rotate within the first sleeve member 50 between the first and second position, movement of the second sleeve member 52 in the axial position is also envisioned. In a preferred embodiment, the housing 36 and the first and second sleeve members 50 and 52 are formed from plastic; however, those skilled in the art will recognize other materials may be used, such as aluminum, while remaining within the scope of that which is claimed.

While the best modes for carrying out the invention have been described in detail, those familiar with the art to which this invention relates will recognize various alternative designs and embodiments for practicing the invention within the scope of the appended claims.

The invention claimed is:

1. A Helmholtz resonator assembly comprising:

a housing partially defining at least one volume;

a first sleeve member disposed within said housing and further defining said at least one volume;

a second sleeve member generally coaxially disposed within said first sleeve member and defining a passage through which a gas may pass;

wherein said second sleeve member is selectively and variably movable with respect to said first sleeve member between a first position and a second position;

at least one orifice defined by said first sleeve member;

at least one other orifice defined by said second sleeve member;

wherein said second sleeve member substantially blocks said at least one orifice to prevent direct and indirect communication between said at least one volume and said passage when said second sleeve member is in said first position;

wherein said at least one other orifice of said second sleeve member aligns with said at least one orifice to allow communication between said at least one volume and said passage when said second sleeve member is in said second position; and wherein said at least one orifice, said at least one other orifice, and said at least one volume cooperate to form at least one Helmholtz resonator when said at least one other orifice of said second sleeve member aligns with said at least one orifice.

2. The Helmholtz resonator assembly of claim 1, wherein said first and second sleeve members are generally cylindrical in shape.

3. The Helmholtz resonator assembly of claim 1, wherein said housing, said first sleeve member, and said second sleeve member are formed from plastic.

4. The Helmholtz resonator assembly of claim 1, wherein said housing is configured to mount to an internal combustion engine.

5. The Helmholtz resonator assembly of claim 1:

wherein said at least one orifice includes a first and second orifice;

wherein said at least one other orifice includes a third and fourth orifice;

wherein said at least one volume includes a first volume and a second volume; and wherein said third orifice is configured to align with said first orifice to allow communication between said first volume and said passage prior to said fourth orifice aligning with said second orifice to allow communication between said second volume and said passage as said second sleeve member moves from said first position to said second position.

6. The Helmholtz resonator assembly of claim 1, further comprising:

an actuator responsive to signals from a controller; and wherein said actuator is configured to selectively and variably move said second sleeve member between said first position and said second position.

7. A Helmholtz resonator assembly for an internal combustion engine comprising:

a housing partially defining a first volume and at least one other volume;

a first sleeve member disposed within said housing and further defining said first volume and said at least one other volume;

a second sleeve member movably disposed within said first sleeve member, said second sleeve member being movable between a first position and a second position and defining a passage through which a gas may pass;

a first and at least one other plurality of orifices defined by said first sleeve member;

a first and at least one other plurality of orifices defined by said second sleeve member;

wherein said second sleeve member substantially blocks said first plurality of orifices and said at least one other plurality of orifices defined by said first sleeve member to prevent direct and indirect communication between said first volume and said at least one other volume and said passage when said second sleeve member is in said first position;

wherein said second sleeve member substantially aligns said first plurality of orifices and said at least one other plurality of orifices defined by said first sleeve member to allow communication between said first volume and said at least one other volume and said passage when said second sleeve member is in said second position;

wherein said first plurality of orifices defined by said first sleeve member, said first plurality of orifices defined by said second sleeve member, and said first volume cooperate to form a first Helmholtz resonator when said first plurality of orifices defined by said first sleeve member is aligned with said first plurality of orifices defined by said second sleeve member; and wherein said at least one other plurality of orifices defined by said first sleeve member, said at least one other plurality of orifices defined by said second sleeve member, and said at least one other volume cooperate to form at least one other Helmholtz resonator when said at least one other plurality of orifices defined by said first sleeve member is aligned with said at least one other plurality of orifices defined by said second sleeve member.

8. The Helmholtz resonator assembly for an internal combustion engine of claim 7, wherein said first and second sleeve members are generally cylindrical in shape.

9. The Helmholtz resonator assembly for an internal combustion engine of claim 7, wherein said housing, said first sleeve member, and said second sleeve member are formed from plastic.

10. The Helmholtz resonator assembly for an internal combustion engine of claim 7, further comprising:

an actuator responsive to signals from a controller; and wherein said actuator is configured to selectively and variably move said second sleeve member between said first position and said second position.

11. The Helmholtz resonator assembly for an internal combustion engine of claim 7, further comprising a coupling member configured to mount said housing to the internal combustion engine.

12. The Helmholtz resonator assembly for an internal combustion engine of claim 7, wherein the Helmholtz resonator assembly is configured to mount within an intake system of the internal combustion engine and wherein said gas is intake air.

13. A Helmholtz resonator assembly comprising:

a housing partially defining at least one volume;

a first generally cylindrical sleeve member disposed within said housing and further defining said at least one volume;

a second generally cylindrical sleeve member generally coaxially disposed within said generally cylindrical first sleeve member and defining a passage through which a gas may pass;

wherein said second generally cylindrical sleeve member is selectively and variably movable with respect to said first generally cylindrical sleeve member between a first position and a second position;

at least one orifice defined by said first generally cylindrical sleeve member;

at least one other orifice defined by said second generally cylindrical sleeve member;

wherein said second generally cylindrical sleeve member substantially blocks said at least one orifice to prevent direct and indirect communication between said at least one volume and said passage when said second generally cylindrical sleeve member is in said first position;

wherein said at least one other orifice of said second generally cylindrical sleeve member aligns with said at least one orifice to allow communication between said at least one volume and said passage when said second generally cylindrical sleeve member is in said second position;

wherein said at least one orifice, said at least one other orifice, and said at least one volume cooperate to form at least one Helmholtz resonator when said at least one orifice is aligned with said at least one other orifice of said second generally cylindrical sleeve member;

an actuator responsive to signals from a controller; and wherein said actuator is configured to selectively and variably move said second sleeve member between said first position and said second position.

14. The Helmholtz resonator assembly of claim 13, wherein the Helmholtz resonator assembly is configured to mount within an intake system of an internal combustion engine and wherein said gas is intake air.

* * * * *